US009396600B2

(12) United States Patent
Wonka et al.

(10) Patent No.: US 9,396,600 B2
(45) Date of Patent: Jul. 19, 2016

(54) SELF-SERVICE SYSTEM FOR PAYING IN AND WITHDRAWING COINS

(75) Inventors: Helge Wonka, Bad Wuennenberg (DE); Eckhard Eick, Paderborn (DE); Thorsten Neumann, Paderborn (DE)

(73) Assignee: Wincor Nixdorf International GmbH (DE)

( * ) Notice: Subject to any disclaimer, the term of this patent is extended or adjusted under 35 U.S.C. 154(b) by 1336 days.

(21) Appl. No.: 12/936,826

(22) PCT Filed: Apr. 17, 2009

(86) PCT No.: PCT/EP2009/054616

§ 371 (c)(1), (2), (4) Date: Oct. 7, 2010

(87) PCT Pub. No.: WO2009/127731

PCT Pub. Date: Oct. 22, 2009

(65) Prior Publication Data

US 2011/0030312 A1 Feb. 10, 2011

(30) Foreign Application Priority Data

Apr. 17, 2008 (DE) ..... 10 2008 019 436

(51) Int. Cl.

| | |
|---|---|
| ***G07D 3/00*** | (2006.01) |
| ***G07D 9/00*** | (2006.01) |
| ***G07D 9/06*** | (2006.01) |
| ***G07D 11/00*** | (2006.01) |
| ***G07D 1/00*** | (2006.01) |

(52) U.S. Cl.

CPC ..... *G07D 9/065* (2013.01); *G07D 1/00* (2013.01); *G07D 9/00* (2013.01); *G07D 11/00* (2013.01)

(58) Field of Classification Search

CPC ..... G07D 9/065; G07D 9/00; G07D 3/14; B65B 43/123; B65B 61/025; B65B 43/267; B65B 2220/22; B31B 2219/924

USPC ..... 53/131, 498, 500, 501, 131.2, 235, 246, 53/147, 266.1, 285, 52, 284.7, 548, 545, 53/546, 555, 151, 570; 453/59

See application file for complete search history.

(56) References Cited

U.S. PATENT DOCUMENTS

| | | | | | |
|---|---|---|---|---|---|
| 2,841,934 | A | * | 7/1958 | Schoenewolf | 53/501 |
| 3,570,212 | A | * | 3/1971 | Murray | 53/501 |
| 3,765,326 | A | * | 10/1973 | Hawkins | 101/44 |
| 3,802,446 | A | * | 4/1974 | Pilat | 453/62 |
| 3,842,573 | A | * | 10/1974 | Price | 53/475 |
| 3,906,964 | A | * | 9/1975 | Ushio et al. | 453/63 |
| 4,058,954 | A | * | 11/1977 | Asami | 53/54 |

(Continued)

FOREIGN PATENT DOCUMENTS

| | | | |
|---|---|---|---|
| EP | 1 583 048 | A | 10/2005 |
| WO | WO-01 38173 | A | 5/2001 |
| WO | WO-2005/104046 | A | 11/2005 |

*Primary Examiner* — Stephen F Gerrity
*Assistant Examiner* — Eyamindae Jallow
(74) *Attorney, Agent, or Firm* — Harness, Dickey & Pierce, P.L.C.

(57) ABSTRACT

A self-service system (10) for depositing and dispensing coins (108, 116) with a device for the input (12) of coins (108, 116) and a device for the output (30) of coins (108, 116). Means are provided which provide the coins (108, 116) to be output from the stock (18*a* to 18*d*) of the deposited coins (108, 116) in the form of a packed coin pack comprising a large number of coins (108, 116).

18 Claims, 5 Drawing Sheets

(56) References Cited

U.S. PATENT DOCUMENTS

| | | | | |
|---|---|---|---|---|
| 4,102,110 | A * | 7/1978 | Iizuka et al. | 53/493 |
| 4,384,644 | A * | 5/1983 | Uchida | 206/0.8 |
| 5,511,364 | A * | 4/1996 | Levi et al. | 53/570 |
| 6,230,928 | B1 | 5/2001 | Hanna et al. | |
| 6,328,150 | B1 * | 12/2001 | Hibari | 194/317 |
| 6,385,944 | B1 * | 5/2002 | Taniguchi et al. | 53/168 |
| 6,470,648 | B1 * | 10/2002 | Baker | 53/411 |
| 6,543,201 | B2 * | 4/2003 | Cronauer et al. | 53/131.5 |
| 6,550,225 | B1 * | 4/2003 | Cahill et al. | 53/459 |
| 6,751,926 | B1 * | 6/2004 | Cooper | 53/79 |
| 6,758,737 | B2 * | 7/2004 | Svensson | 453/59 |
| 6,837,023 | B1 * | 1/2005 | Glatfelter, Jr. | 53/64 |
| 7,637,078 | B2 * | 12/2009 | Ishiwatari et al. | 53/52 |
| 8,186,896 | B2 * | 5/2012 | Frost et al. | 400/607 |
| 8,523,641 | B2 * | 9/2013 | Kuykendall | G07F 9/08 453/61 |
| 2003/0093971 | A1 * | 5/2003 | Terminella et al. | 53/133.4 |
| 2003/0111395 | A1 | 6/2003 | Aas et al. | |
| 2003/0220064 | A1 | 11/2003 | Svensson | |
| 2003/0230052 | A1 * | 12/2003 | Rabiea | 53/459 |
| 2004/0025476 | A1 * | 2/2004 | Oliverio et al. | 53/450 |
| 2004/0084106 | A1 * | 5/2004 | James | 141/313 |
| 2005/0060956 | A1 * | 3/2005 | Yui | 53/399 |
| 2006/0054455 | A1 * | 3/2006 | Kuykendall | G07F 9/08 194/217 |
| 2006/0075329 | A1 * | 4/2006 | Sullivan et al. | 715/507 |
| 2007/0108267 | A1 * | 5/2007 | Jonsson et al. | 235/379 |
| 2007/0175235 | A1 * | 8/2007 | Metzger | 62/344 |
| 2007/0227098 | A1 * | 10/2007 | Weitzel | 53/443 |
| 2008/0227611 | A1 * | 9/2008 | Aspenns et al. | 493/267 |
| 2010/0011710 | A1 * | 1/2010 | Pape | 53/450 |
| 2010/0024363 | A1 * | 2/2010 | Pape | 53/459 |
| 2010/0170206 | A1 * | 7/2010 | Kim | 53/525 |
| 2010/0180547 | A1 * | 7/2010 | Foucher et al. | 53/411 |
| 2010/0189379 | A1 * | 7/2010 | Razzaboni et al. | 383/33 |
| 2011/0100863 | A1 * | 5/2011 | Luciano | 206/534 |
| 2013/0091802 | A1 * | 4/2013 | Bentley et al. | 53/111 R |

* cited by examiner

SELF-SERVICE SYSTEM FOR PAYING IN AND WITHDRAWING COINS

CROSS-REFERENCE TO RELATED APPLICATIONS

This application is a National Stage of International Application No. PCT/EP2009/054616, filed Apr. 17, 2009. This application claims the benefit and priority of German application 10 2008 019 436.0, filed Apr. 17, 2008. The entire disclosures of the above applications are incorporated herein by reference.

BACKGROUND

This section provides background information related to the present disclosure which is not necessarily prior art.

1. Technical Field

The invention relates to a self-service system for depositing and dispensing coins comprising a device for the input of coins and a device for the output of coins.

2. Discussion

From self-service zones in banks, self-service machines for supplying coins and the removal of coins are known. Retailers are supplied with coins (supply of change) by the provision of defined coin packs (e.g. in the form of coin rolls wrapped in paper). When removing the day's takings, the mass coin deposit plays an important role, a large number of coins being deposited for example via a funnel-shaped input device. In the self-service field there exists at present separate systems for both applications, i.e. mass coin deposit machines and coin roll dispensing machines. Both systems are operated by the respective branch banks. The emptying of the mass coin deposit machines and the filling of the coin roll dispensing machines take place in two completely separate processes by bank employees or by employees of cash transport companies. For the operation of both of the two separate systems considerable running costs are incurred.

SUMMARY OF THE INVENTION

Therefore, it is an object of the invention to specify a self-service system which is suitable for coin supply and coin removal.

By the combination of a device for the input of coins and a device for the output of coins in the form of wrapped coin packs in one self-service system, it is achieved that for coin supply and for coin removal only one self-service system is still required. Hereby, both the acquisition costs and the running costs are reduced. Further, the required installation space is reduced. Since the deposited coins are at least in part again dispensed, the time intervals in which coins have to be supplied to the self-service system by a bank employee or an employee of a cash transport company or in which coins have to be removed from the self-service system are longer than in the case of a mere coin deposit machine or, respectively, a mere coin roll dispensing machine.

It is advantageous to provide a collecting and packing unit with the aid of which the coins to be dispensed are each time put together and packed to form a coin pack or coin packs only upon request of a user. It is particularly advantageous when the request of the user includes information on the number of coins in the coin pack to be dispensed and/or information on the value of the coins in the coin pack. Hereby it is achieved that the value of the coin pack and/or the combination of the coin pack can be chosen freely or within a preset range by the user.

Furthermore, it is advantageous when, with the aid of the collecting and packing unit, packed coin packs are formed from the stock of deposited coins and are stored in a coin pack storage, which packs are predefined with respect to the number of coins and the value of the coins, one of the coin packs or, respectively, the coin packs stored in the coin pack storage being output to the user upon his request. Hereby it is achieved that the time required for the output of the coin pack requested by the user is reduced. It is particularly advantageous when the preset number of coins and the preset value of the coins of the pre-produced coin pack are chosen such that those coin packs are formed which are most often requested by the user.

In a preferred embodiment of the invention, the number, the value and the denomination of the coins in the coin pack are indicated on the package of the packed coin pack for information purposes. It is advantageous to provide a printing device for printing this information on the package of the coin pack. Alternatively, coin pack packages with pre-printed information can be used and the coins are filled into the respective coin pack packages in accordance with the pre-printed information. By means of this pre-printed information, the user quickly obtains all required information on the coin pack, as a result whereof the handling is simplified.

The coin packs are preferably packed with the aid of the collecting and packing unit such that a future opening of the package of the coin pack can be determined. In this way, possible manipulations can be determined easily and immediately.

As packages for the coin pack preferably plastic bags are used. Such plastic bags can be easily manufactured and can be obtained in a cost-efficient manner.

In a particularly preferred embodiment of the invention a plastic bag stock consisting of a large number of interconnected plastic bags arranged on a roll is provided in the self-service system. The plastic bags can be rolled off from the plastic bag roll for filling in the coins in the collecting and packing unit. The collecting and packing unit comprises a closing unit for closing the plastic bags after filling with the coins and a separating unit for separating the filled plastic bags from the plastic bag roll. The separating unit comprises in particular a cuffing element with which the last filled plastic bag is cut off from the plastic bags of the plastic bag roll which have not yet been filled. Hereby it is achieved that no waste is incurred, as a result whereof the maintenance expense can be reduced and the environmental friendliness can be increased. By using a plastic bag roll for the storing of plastic bags an easy handling of the plastic bags, in particular an easy transport of the plastic bags from the plastic bag stock into the collecting and packing unit is achieved. Further, in this way the not yet filled plastic bags can be easily supplied to the self-service system. Alternatively, the plastic bags can be stored individually in the plastic bag stock. A filled plastic bag is preferably closed by welding.

Further, it is advantageous when the plastic bags on the plastic bag roll each have at least one readable marking for the controlled transport of the plastic bags to the collecting and packing unit.

The collecting and packing unit preferably comprises a filling unit for filling the plastic bags with the coins. The filling unit in turn comprises in particular a blow nozzle for the opening of a filling opening of the plastic bags with the aid of an air stream generated by the blow nozzle, and a filling funnel for supplying the coins into the plastic bag through the filling opening. In this way an easy and reliable feeding of the coins into the plastic bags is achieved.

The plastic bags each comprise a rear side and a front side, the width of the rear side and the width of the front side being equal and the height of the rear side being larger than the height of the front side. The rear side and the front side are connected to one another such that by the front side and a part of the rear side a receiving area for receiving the coins is formed. The plastic bags are in particular produced such that a foil of plastic material, from which the plastic bags are made, is rolled off from a continuous roll and is folded over with a different leg length. In this way, the different height of the front side and the rear side is achieved. The front side and the rear side are welded together with a weld seam orthogonal to the direction of transport of the foil or the plastic bags. In this way, a cost-efficient production of the plastic bags or, respectively, the plastic bag roll is achieved.

BRIEF DESCRIPTION OF THE DRAWINGS

Further features and advantages of the invention result from the following description which in connection with the enclosed Figures explains the invention in more detail with reference to embodiments.

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
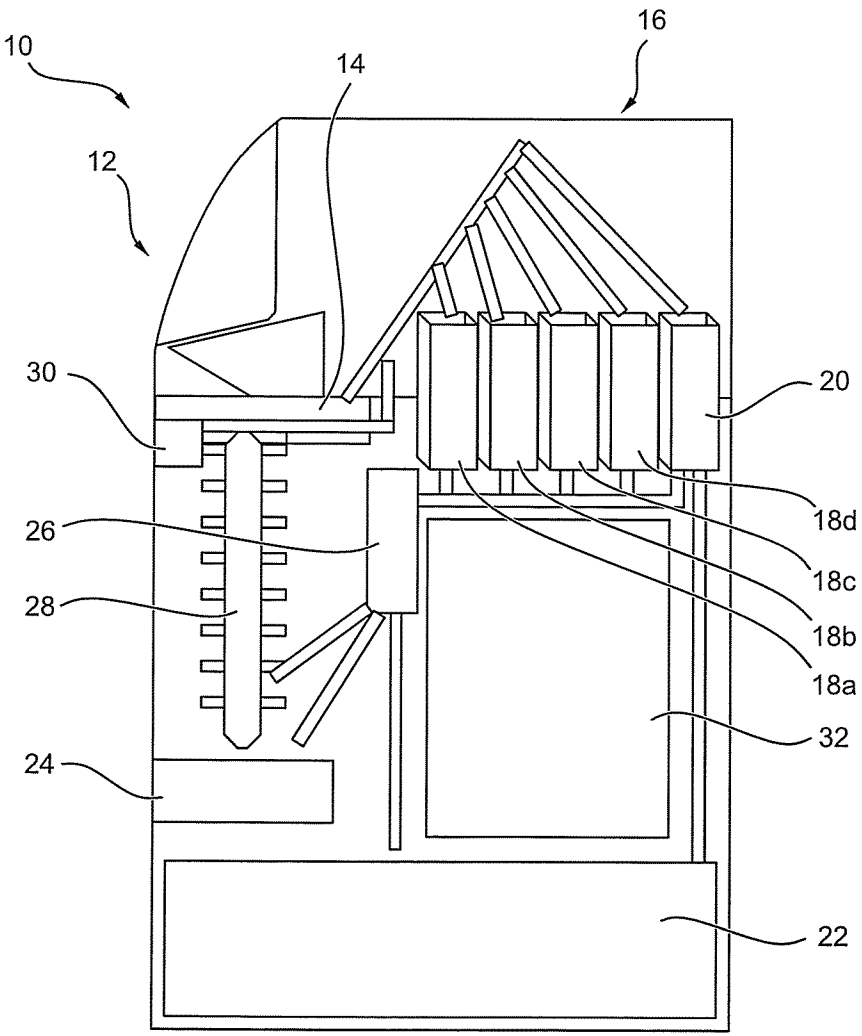
FIG. 1 shows a schematic illustration of a self-service system.

In FIG. 1, a schematic illustration of a self-service system for depositing and dispensing coins is shown. In a depositing transaction, coins are input into an input compartment 12 by a user and are checked with the aid of a coin separating and counting machine 14. The deposited coins are conveyed with the aid of a sorting unit 16 into coin storages 18*a* to 18*d* or into an intermediate storage 20. The intermediate storage 20 is also referred to as escrow. After a deposit confirmation by the user, the coins intermediately stored in the intermediate storage 20 are conveyed into a transport container 22. The depositing transaction is terminated herewith. In the case of a cancellation of the depositing transaction, the coins are conveyed from the intermediate storage 20 and the coin storages 18*a* to 18*d* to a return compartment 24 and are output to the user.

In a dispensing transaction, a number of coin packs each formed of a large number of coins is dispensed. For this, the number of coins required for forming the respective coin packs is taken from the respective coin storages 18*a* to 18*d* and separated and transported to a collecting and packing unit 26 for collecting and packing the coins to form the coin packs. Here, the coins are filled into a coin pack package through a filling opening of the package for the coin pack, and the filling opening is welded in a revision secure manner so that possible manipulations can be determined immediately and easily. As packages for coin packs, bags or sachets are typically used. The bags are in particular made of plastic. The bags are then deposited in a coin pack storage 28. From the coin pack storage 28, the bags can be transported into a dispensing compartment 30 for dispensing coin packs. Coin packs which have been produced upon request of the user can be directly dispensed by the coin pack storage 28. Such coin packs produced upon request of the user are also referred to as coin packs produced "on-demand". Alternatively or additionally, in times in which the self-service system 10 is not used by a user (standby times), the coin pack storage 28 is pre-filled with the most common coin packs in a location-optimized manner in order to dispense these without production time if necessary. The coins of which the coin packs are formed are in particular coins which have previously been deposited in the self-service system 10 and which have been stored in the coin storages 18*a* to 18*d*. If more coins are deposited in the self-service system 10 than are dispensed again, then the deposited coin surplus in the transport unit 22 can be removed from the self-service system 10 by a cash transport company. For this, either revision-secure cassettes are provided or the removal takes place with the aid of thin-walled transport containers, so-called safebags.

An emptying of the coin storages 18*a* to 18*d* into the transport unit 22 is likewise possible. Hereby, an emptying of the entire coin stock by the cash transport company is possible. Since it can be expected that most self-service systems 10 for depositing and dispensing coins are long on deposits, i.e. more coins are deposited than dispensed, the cash transport company removal interval can be extended by providing the coin recycling function. Coin deposit and coin dispensing by only one machine is referred to as coin recycling function. The cash transport company removal interval is the temporal distance between removals of the transport unit 22 from the self-service system 10.

Before the beginning of the dispensing transaction, a bag is taken from the bag stock 32 and transported into the collecting and packing unit 10. The coins removed from the coin storages 18*a* to 18*d* fall through the filling opening of the bag into a receiving area of the bag. Subsequently, the bag and thus the coin pack is closed in a revision-secure manner by welding. After this operation, the produced coin pack is transported to the coin pack intermediate storage 28. On the bag, the nominal filling values are already printed and readable from outside. The bags already pre-printed with a standard imprint are filled with the coins in accordance with the information printed thereon. In an alternative embodiment of the invention, a printing unit for printing the bag with an individual imprint is provided in the collecting and packing unit 26. In both cases, the imprint created can comprise the denomination contained, the value of the coins, and/or the number of coins.

Figure 2:
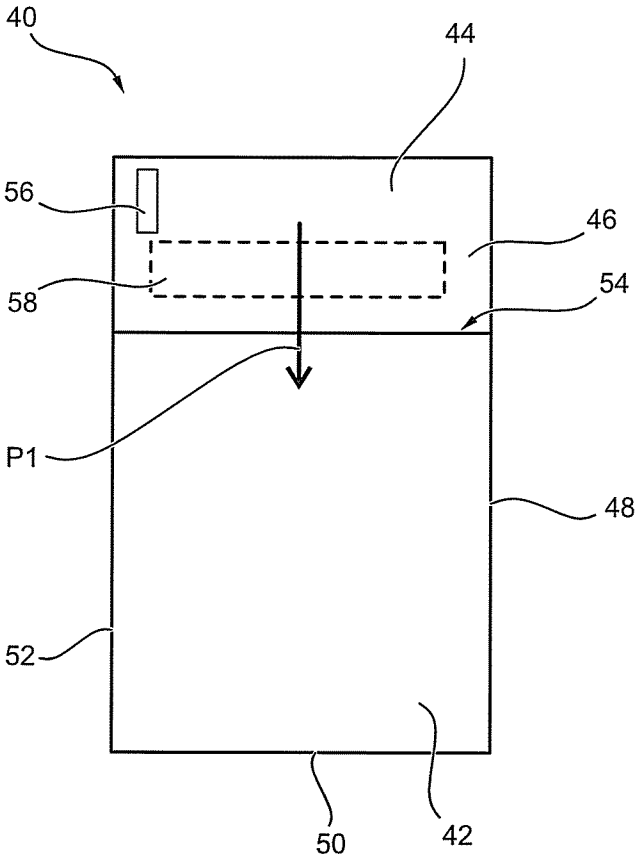
FIG. 2 shows a schematic illustration of a plastic bag.

In FIG. 2, a schematic illustration of a bag 40 for receiving the coins is shown. Elements having the same structure or the same function are identified by the same reference signs.

The bag 40 comprises a front side 42 and a rear side 44. The width of the front side 42 and the width of the rear side 44 are equal. The rear side 44 of the bag is designed longer than the front side 42, i.e. the rear side 44 has a greater height than the front side 42. The front side 42 and the rear side 44 are firmly joined to one another at the edges 48, 50, 52 so that by the front side 42 and a part of the rear side 44 a receiving area for receiving the coins of the coin pack is formed.

The coins are supplied to the receiving area of the bag 40 via a filling opening 54 in the direction of the arrow P1. The excess length resulting from the different heights of the rear side 44 and the front side 42 is used as a transport and holding tab 46 for transporting and holding the bag 40. A mark 56 printed on the transport and holding tab 46 serves to control the transport of the bag 40. The bag 40 is preferably made of printable plastic material. The printable area 58 is indicated in FIG. 2 by the rectangle illustrated in broken lines.

The bag stock 32 is in particular formed in the form of a bag roll. The bag roll comprises a large number of bags 40 which are continuously rolled up to form the bag roll.

Figure 3:
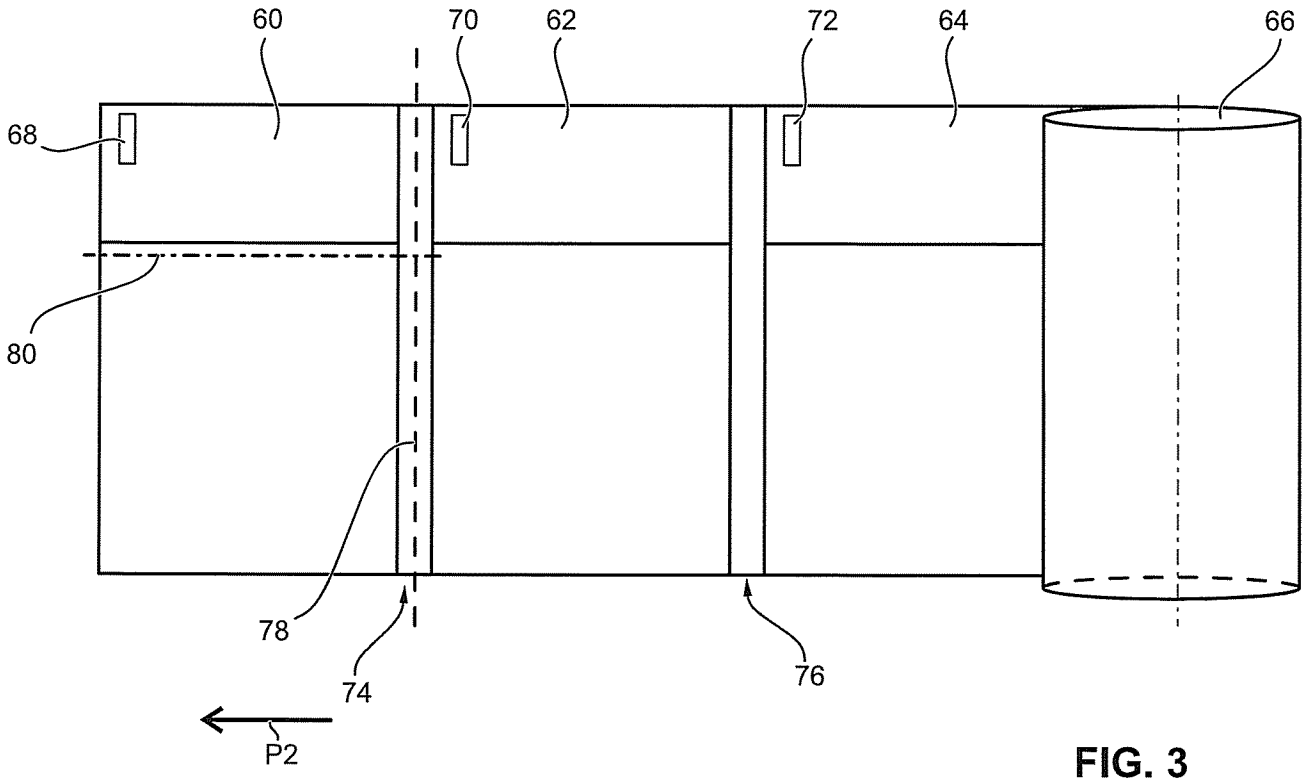
FIG. 3 shows a schematic illustration of a plastic bag roll comprising a large number of plastic bags according to FIG. 2.

In FIG. 3, a schematic illustration of such a bag roll is shown. The bags 60 to 64 are arranged laterally to one another to form a band and can be continuously rolled around a roll 66. Despite the generally common term "continuous", the bag roll comprises a limited number of bags 60 to 64. Several bags 60 to 64 produced in a manner so as to be laterally connected to one another and forming a band are also referred to as "continuous bags". Such continuous bags can be produced cost-efficiently in that a foil is rolled off from a roll, is folded over with a different leg length and is welded with only one weld seam orthogonal to the direction in which the foil is rolled off from the roll 66. Subsequently, the printing of the marks 68 to 72 onto the bags 60 to 64 takes place. When producing bags 60 to 64 with a standard imprint, this one, too, is printed onto the bags 60 to 64. Subsequently, the bags 60 to 64 produced in this way are rolled around the roll 66.

Between two adjacent bags 60 to 64, there is one separating area 74, 76 each in which a separating cut between the bags 60 to 64 can be placed. One of these separating cuts is illustrated by the broken line 78 and is exemplarily identified by the reference sign 78. The pre-fabricated bags 60 to 64 of the bag roll are then rolled off from the roll 66 in the direction of transport P2 and are supplied to the collecting and packing unit 26. The filled bags 60 to 64 are welded after filling. The weld seam of the bag 60 is illustrated by the dot and dashed line 80.

Insertion and clamping of a new bag roll into the bag stock 32 is easy, and this can be done by an untrained operator, in particular a bank employee. By the previously described production process of the bags 60 to 64, in particular by the separating of two adjacent bags 60 to 64 along the separating cut 78 the production of the bags 60 to 64 takes place without incurring waste.

Figure 4:
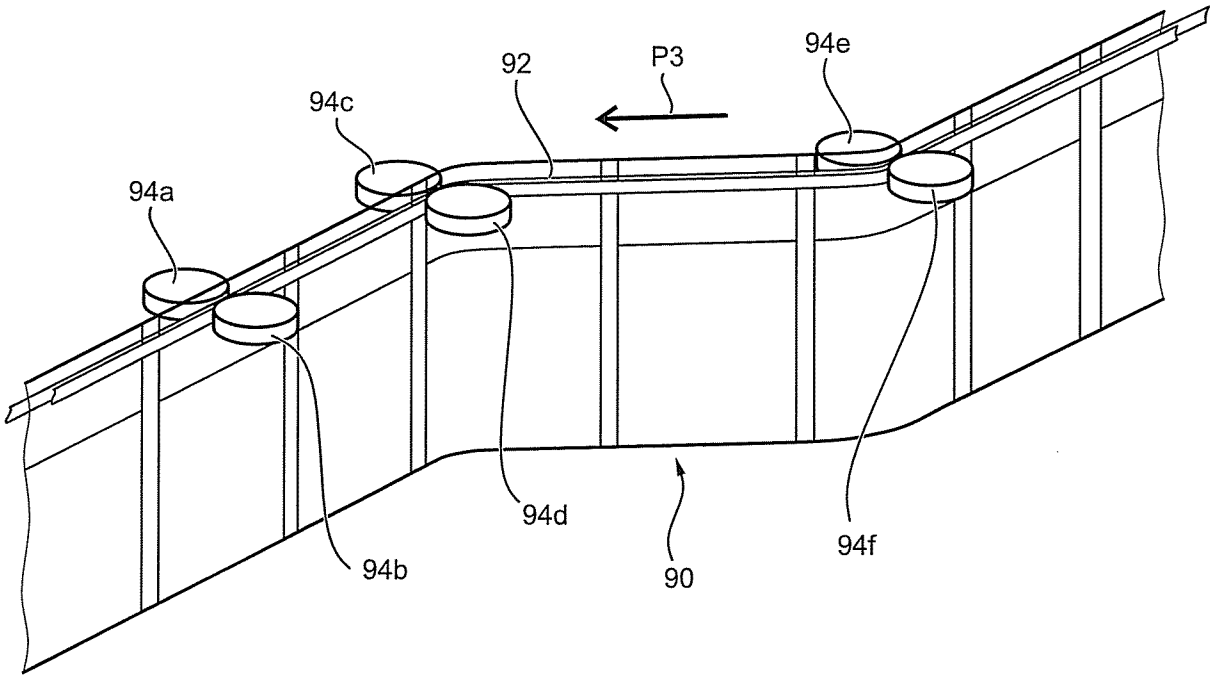
FIG. 4 shows a schematic illustration of the transport of the plastic bags in the self-service system.

In FIG. 4, a schematic illustration of the transport of a continuous bag 90 along a transport path in transport direction P3 is shown. When operating the self-service system 10, the continuous bag 90 is rolled off from the roll 66 and is transported between two toothed belts of a belt pair 92 along a transport path to the collecting and packing unit 26. There, the bags 60 to 64 of the "continuous bag" 90 are opened and filled with the coins.

The belt pair 92 is guided and driven with the aid of a large number of rolls 94*a* to 94*f*. In accordance with the arrangement of the rolls 94*a* to 94*f*, the transport path can have an arbitrary contour.

Figure 5:
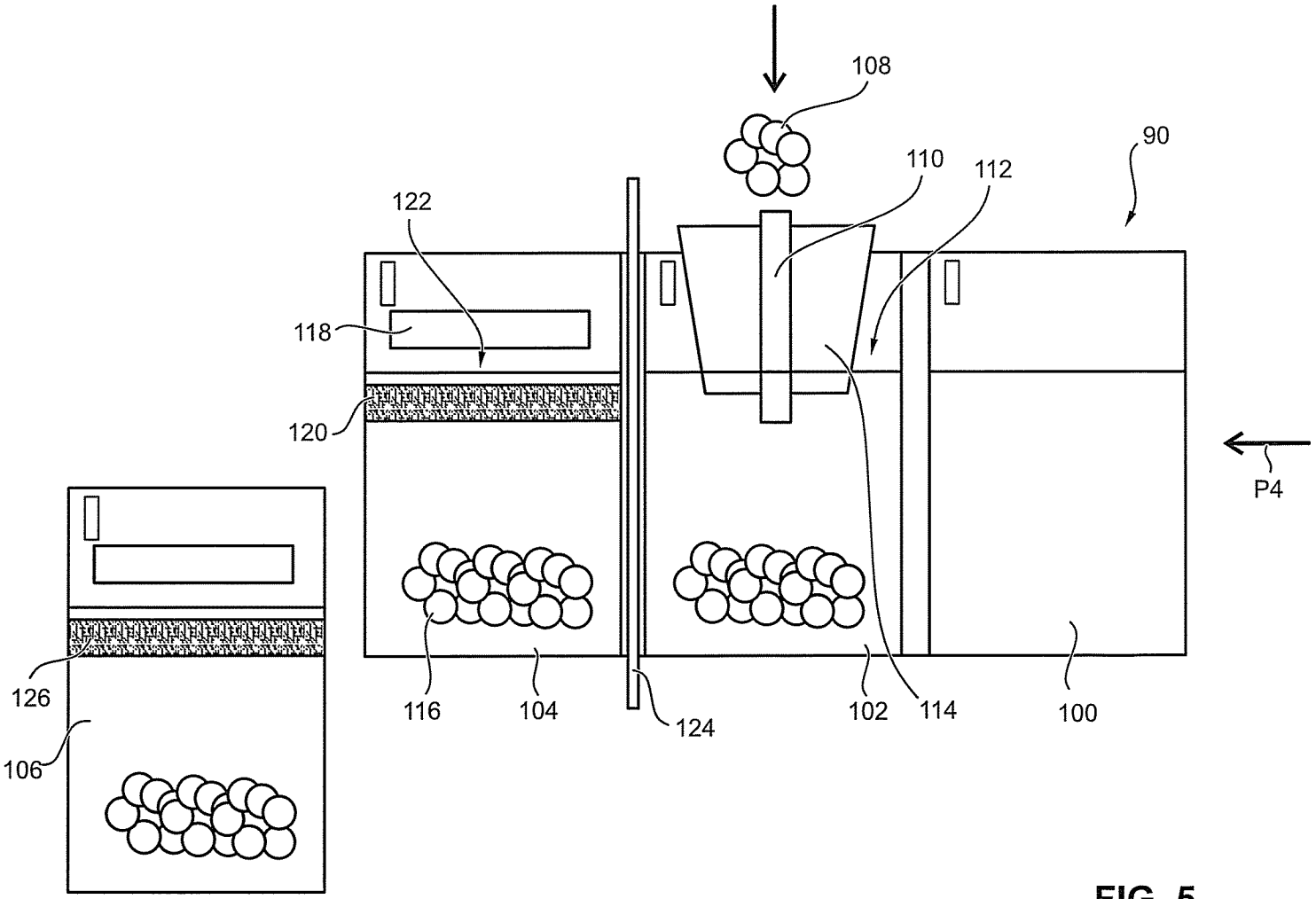
FIG. 5 shows a schematic illustration of the filling of the plastic bags with coins.

In FIG. 5, four bags 100 to 106 are shown during filling of the bags 100 to 106 with coins 108. The collecting and packing unit 26 comprises a blow nozzle 110 for the opening of the filling opening 112 of the bag 102 via the supply of an air stream into the bag 102. Further, the collecting and packing unit 26 comprises a coin filling funnel 114 for supplying the coins 108 through the filling opening 112 into the receiving area of the bag 102.

The bag 104 which is arranged downstream of the bag 102 in transport direction P4 and directly adjacent to this bag 102 is already completely filled with the coins 116 to be dispensed. The bag 104 is printed in the area 118 and the filling opening 122 of the bag 104 is closed by welding in the welding area 120. With the aid of a separating element 124, the bag 104 is separated from the bag 102. The bag 106 is already separated from the other bags 100 to 104 and welded by the weld seam 126.

When filling a bag 102 with coins 108, in a first step the continuous bag 90 inserted between the belt pair 92 is moved such that a bag 102 which has not yet been filled hangs under the coin filling funnel 114. This position is also referred to as an initial position. In a second step, the filling opening 112 of the bag 102 is opened with the aid of the blow nozzle 110 via the supply of an air stream into the bag 102. In the next step, the coin filling funnel 114 is lowered into the filling opening 112 of the bag 102. The coins 108 fall into the bag 102. In the next step, the non-illustrated drive transports the continuous bag one position further, i.e. the next empty bag 100 is located under the coin filling funnel 114, while the just filled bag 102 is transported into the next position. In the next step, the bag 102 is welded and subsequently printed. Thereafter, the bag 102 is cut off from the bag roll and transported into the coin pack storage 28.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed:

1. A self-service system for depositing and dispensing coins, comprising:

a device for the input of a supply of coins of various denominations;

a collecting and packing unit;

a roll of interconnected plastic bags to be filled with coins in the collecting and packing unit;

wherein the self-service system operates in at least two modes including a stand-by mode and a user request mode; the stand-by mode requiring no user input and the user request mode requiring user input;

wherein in the stand-by mode the collecting and packing unit fills at least one of the plastic bags with coins of a preselected denomination;

wherein in the user request mode the collecting and packing unit fills at least one of the plastic bags with coins of a denomination selected by a user, which denomination is different than the preselected denomination;

the collecting and packing unit includes a closing unit for closing the plastic bags after being filled with the coins and a separating unit for separating the filled plastic bags from the plastic bag roll in order to form coin packs;

a coin pack storage unit for storing the coin packs formed during the stand-by mode; and an output compartment for dispensing one or more of the stored coin packs in response to the self-service system receiving a user request for coins of a preselected denomination or for dispensing coin packs in response to the self-service system receiving a user request for coins of a denomination which is different than the preselected denomination.

2. The self-service system according to claim 1, wherein the user request includes number and value of coins requested.

3. The self-service system according to claim 1, wherein the number, the value and the denomination of coins in the pre-filled coin packs is printed on the pre-filled coin packs.

4. The self-service system according to claim 3, further including a printing device for printing the information on the pre-filled coin packs.

5. The self-service system according to claim 3, wherein bags with preprinted information are used.

6. The self-service system according to claim 1, wherein by the collecting and packing unit the coin packs are packed such that a future opening of the coin pack can be determined.

7. The self-service system according to claim 1, wherein the plastic bags of the plastic bag roll each have at least one readable marking for the control of the transport of the plastic bags to the collecting and packing unit.

8. The self-service system according to claim 1, wherein the collecting and packing unit comprises a filling unit for filling the plastic bags with coins.

9. The self-service system according to claim 8, wherein the filling unit comprises a blow nozzle for the opening of the filling opening of the plastic bag by an air stream and a filling funnel for supplying the coins into the plastic bag.

10. The self-service system according to claim 1, wherein the closing unit welds the filling opening of the plastic bag.

11. The self-service system according to claim 1, wherein each plastic bag comprises a rear side and a front side, the width of the rear side and the width of the front side being equal and the height of the rear side being greater than the height of the front side, and the rear side and the front side being connected with each other such that by the front side and a part of the rear side a receiving area for receiving the coins is formed.

12. A self-service system for depositing and dispensing coins, the self-service system comprising:

a coin input compartment;

a coin sorting unit;

a coin storage unit;

a plastic bag stock including a roll of a plurality of interconnected, preformed plastic bags;

a collecting and packing unit;

wherein the self-service system operates in at least two modes including a stand-by mode and a user request mode; the stand-by mode requiring no user input and the user request mode requiring user input;

wherein in the stand-by mode the collecting and packing unit fills at least one of the plastic bags with coins of a preselected denomination;

wherein in the user request mode the collecting and packing unit fills at least one of the plastic bags with coins of a denomination selected by a user, which denomination is different than the preselected denomination;

a closing unit for closing the preformed bags after being filled with coins; and a separating unit for separating the preformed bags from the roll after being filled with coins in order to form coin packs;

a coin pack storage unit for storing the coin packs formed during the stand-by mode; and an output compartment configured to dispense one or more of the stored coin packs in response to the self-service system receiving a user request for coins of a preselected denomination or to dispense coin packs in response to the self-service system receiving a user request for coins of a denomination which is different than the preselected denomination.

13. The self-service system of claim 12, wherein the collecting and packing unit further includes a blow nozzle configured to open a filling opening of each one of the preformed bags by supplying an air stream into each one of the preformed bags.

14. The self-service system of claim 13, wherein the collecting and packing unit further includes a coin filling funnel configured to deposit coins into each one of the preformed bags.

15. The self-service system of claim 14, wherein the blow nozzle and the coin filling funnel are configured to be inserted into each one of the preformed bags through a filling opening thereof.

16. The self-service system of claim 15, wherein the closing unit is configured to weld the filling opening of the preformed bags to close the preformed bags.

17. The self-service system of claim 15, wherein each one of the preformed bags includes:

a rear side having a rear width and a rear height; and a front side having a front width that is equal to the rear width and a front height that is less than the rear height;

wherein the rear side and the front side are connected to define a coin receiving area.

18. A self-service system for depositing and dispensing coins, comprising:

a device for the input of coins;

a collecting and packing unit for forming coin packs from a stock of previously deposited coins of various denominations; and a printing device configured to print information on each of the coin packs, the information including at least one of a number of coins in the coin pack, a value of coins in the coin pack, and a denomination of coins in the coin pack;

a roll of interconnected plastic bags to be filled with coins in the collecting and packing unit;

wherein the self-service system operates in at least two modes including a stand-by mode and a user request mode; the stand-by mode requiring no user input and the user request mode requiring user input;

wherein in the stand-by mode the collecting and packing unit fills at least one of the plastic bags with coins of a preselected denomination;

wherein in the user request mode the collecting and packing unit fills at least one of the plastic bags with coins of a denomination selected by a user, which denomination is different than the preselected denomination;

the collecting and packing unit includes a closing unit for closing the plastic bags after being filled with the coins and a separating unit for separating the filled plastic bags from the plastic bag roll in order to form coin packs;

a coin pack storage unit for storing the coin packs formed during the stand-by mode; and an output compartment for dispensing one or more of the stored coin packs in response to the self-service system receiving a user request for coins of a preselected denomination or for dispensing coin packs in response to the self-service system receiving a user request for coins of a denomination which is different than the preselected denomination.

* * * * *